US011761629B2

(12) United States Patent
Höflinger et al.

(10) Patent No.: US 11,761,629 B2
(45) Date of Patent: Sep. 19, 2023

(54) HEATING DEVICE AND METHOD FOR REGULATING A FAN-OPERATED GAS BURNER

(71) Applicant: Truma Gerätetechnik GmbH & Co. KG, Putzbrunn (DE)

(72) Inventors: Ulrich Höflinger, Reit im Winkl (DE); Wilhelm Laux, Munich (DE)

(73) Assignee: Truma Gerätetechnik GmbH & Co. KG, Putzbrunn (DE)

( * ) Notice: Subject to any disclaimer, the term of this patent is extended or adjusted under 35 U.S.C. 154(b) by 383 days.

(21) Appl. No.: 17/269,653

(22) PCT Filed: Aug. 20, 2019

(86) PCT No.: PCT/EP2019/072226
§ 371 (c)(1),
(2) Date: Feb. 19, 2021

(87) PCT Pub. No.: WO2020/038919
PCT Pub. Date: Feb. 27, 2020

(65) Prior Publication Data

US 2021/0254830 A1 Aug. 19, 2021

(30) Foreign Application Priority Data

Aug. 21, 2018 (DE) ..... 10 2018 120 377.2

(51) Int. Cl.
*F23N 5/12* (2006.01)
*F23D 14/34* (2006.01)
*F23N 5/18* (2006.01)

(52) U.S. Cl.
CPC ..... *F23N 5/123* (2013.01); *F23D 14/34* (2013.01); *F23N 2005/181* (2013.01); *F23N 2229/12* (2020.01); *F23N 2233/08* (2020.01)

(58) Field of Classification Search
None
See application file for complete search history.

(56) References Cited

U.S. PATENT DOCUMENTS 5,971,745 A * 10/1999 Bassett ..... F23N 1/022 431/12

FOREIGN PATENT DOCUMENTS

CN 102245976 A 11/2011
CN 103443547 A 12/2013
(Continued)

*Primary Examiner* — Jason Lau
(74) *Attorney, Agent, or Firm* — Murphy, Bilak & Homiller, PLLC

(57) ABSTRACT

A method for regulating a gas burner, wherein the gas burner has a combustion air supply fan whose rotational speed can be set variably, has the following steps: —operating the fan and detecting a fan rotational speed (nVBL); —changing the fan rotational speed; —measuring an ionization voltage (UION) which correlates with an ionization flow in a flame region of the gas burner; —finding a minimum of a gradient of the measured ionization voltage at the current fan rotational speed; —determining an operating point by measuring the current ionization voltage and storing as an operating point; —while the burner is operating, continuously measuring the current ionization voltage; —determining a deviation between the currently measured ionization voltage and the operating point; —checking whether the deviation (Delta UION) is within a predefined limit (UY) and carrying out a case differentiation: +if the deviation is within the predefined limit (UY), continuing the continuous measurement of the current ionization voltage; +if the deviation is not within the predefined limit (UY), repeating the method from the above change in the fan rotational speed.

14 Claims, 2 Drawing Sheets

(56) References Cited

FOREIGN PATENT DOCUMENTS

| | | | |
|---|---|---|---|
| CN | 104285103 | A | 1/2015 |
| DE | 19831648 | A1 | 1/2000 |
| DE | 19947181 | A1 | 12/2001 |
| DE | 102005012388 | A1 | 10/2006 |
| DE | 102008027010 | A1 | 12/2008 |
| DE | 102015116458 | A1 | 3/2017 |
| DE | 102017204012 | A1 | 3/2018 |
| EP | 2014985 | A2 | 1/2009 |
| EP | 2357410 | A2 | 8/2011 |

* cited by examiner

HEATING DEVICE AND METHOD FOR REGULATING A FAN-OPERATED GAS BURNER

The invention relates to a method for regulating a gas burner, wherein the gas burner has a combustion air supply fan, the speed of which can be variably set. In addition, the invention relates to a heating device with a corresponding controllable gas burner.

For monitoring the presence of a flame in a gas burner, various possibilities are known, which, in particular, are based on thermal, optical or electrical principles. The ionization flame detection, where the ionization effect of a flame is used to detect whether the burner generates a flame or not, is deemed to be particularly reliable.

Examples of such devices are, for example, described in EP 2 357 410 A2 and DE 10 2005 012 388 A1.

For the ionization flame detection, an alternating voltage is applied in the area of the flame, mostly with the aid of an ionization electrode and a ground electrode. If the flame burns, a rectification effect on the alternating voltage is caused, which causes a current flow from the ground electrode to the ionization electrode. This current flow is evaluated or processed by measurement electronics and can be provided in the form of an ionization voltage. Thus, the ionization voltage provided as a measurement result at the output of the measurement electronics correlates with the ionization current.

If the measurement electronics output an ionization voltage which exceeds a specific limit value, such excess is recognized as the presence of a flame. In contrast, falling below a corresponding limit value can be interpreted as no flame is burning.

Gas burners, especially fan-operated gas burners, are often subjected to frequently changing ambient conditions which can lead to a variable combustion behavior. Such ambient parameters are, for example, air pressure, temperature of the supplied combustion air, gas pressure (pressure at which the combustion gas is supplied), type of gas and also the energy value of the gas. In this process, it must be taken into account that the composition of the combustion gas can often vary. For example, the composition can be variable for typical gas mixtures such as LPG (Liquefied Petroleum Gas—Autogas) or typical propane/butane mixtures. For example, depending on the gas supply, it is possible that pure propane, pure butane or also an undefined propane/butane mixture is supplied.

Due to the variable ambient parameters, there is a possibility that the gas burner is not operated at the optimal operating point where the combustible is optimally burnt, and the exhaust emission is minimal. Often this condition is characterized as $\lambda=1$ where combustion gas and oxygen are in a stoichiometrically determined ratio.

DE 10 2017 204 012 A1 describes a method for regulating a gas burner.

A method for checking an ionization signal of a burner is known from DE 10 2008 027 010 A1.

DE 10 2015 116 458 A1 describes a method for differentiating two combustion gases with differently high energy contents intended for a combustion process.

Another method for regulating a gas burner is described in U.S. Pat. No. 5,971,745 A.

DE 199 47 181 A1 discloses a method for determining a signal representative of the current air ratio.

Finally, DE 198 31 648 A1 covers a method for functionally adapting control electronics to a gas appliance.

The invention is based on the object to provide a method for regulating a gas burner with which a defined operating point for the operation of a burner can be ensured. The operating point should then be close to the optimum for the operation of the burner.

The object is, in accordance with the invention, achieved by a method having the features of claim 1. Advantageous embodiments are stated in the dependent claims.

A method for regulating a gas burner is stated, where the gas burner has a combustion air supply fan, the speed of which can be variably set. The method includes, in particular, the following steps of:

- operating the fan and detecting a fan speed;
- changing the fan speed;
- measuring an ionization voltage which correlates to an ionization current in a flame area of the gas burner;
- finding a minimum of a gradient of the measured ionization voltage with respect to the current fan speed;
- determining an operating point by measuring the current ionization voltage and storing it as an operating point;
- during the operation of the burner, continuously measuring the current ionization voltage;
- determining a deviation between the currently measured ionization voltage and the operating point;
- checking whether the deviation lies within a predefined limit and performing a case discrimination: if the deviation lies within the predefined limit, continuing the continuous measurement of the current ionization voltage; if, however, the deviation does not lie within the predefined limit, repeating the method from the above step of "changing the fan speed".

Usually, the method is performed by a processing and control unit which processes the method steps and, in this process, communicates with the corresponding components (flame detector or ionization voltage sensor, fan motor, etc.).

Thus, with the aid of the method, the fan of the gas burner is operated to supply combustion air. In this process, the fan speed is detected in a suitable manner, for example, by one or more Hall sensors or by determining the so-called commutation harmonics of the rotor and stator package on the supply voltage of the rotor. Accordingly, pulses per minute can, for example, be generated by a measuring device and made available to a processing and control unit. To detect the speed, also other methods are known which are suitable for the regulation described herein.

The processing and control unit is capable of changing, i.e. reducing or increasing, the fan speed. To that end, it can control the fan motor accordingly.

According to the method, an ionization voltage is measured which correlates to an ionization current in a flame area of the gas burner. The voltage value is generated by a rectified frequency signal of the burner flame and made available through a so-called shunt resistance and by means of an analog-to-digital conversion of the processing and control unit.

As set forth above, in the case that a flame is present, a current flow (ionization current) emerges due to the rectification effect of the flame on the applied alternating voltage. This ionization current is converted into a representative voltage (ionization voltage) with the aid of an evaluation circuit with a differential amplifier, so that further evaluation can be performed based on the voltage or, following analog-to-digital conversion, digitally. Thus, the voltage values can be digitalized and further processed.

According to the method, during the change in the fan speed, an attempt is made to find a minimum of a gradient of the measured ionization voltage with respect to the current fan speed. Thus, the fan speed is purposefully changed, i.e. reduced or increased. At the same time, the ionization voltage is determined. As long as the ionization voltage changes more than the fan speed, the fan speed will be further varied. Only when the optimum in the form of the minimum of the gradient has been found, no further change in speed will occur.

The mentioned gradient describes the change in ionization voltage measured in the flame in relation to the change in speed of the combustion air fan. At the minimum of the gradient lies exactly the point which serves as a distinguishing feature or boundary between a rich or a lean operation of the gas burner. At a lower speed, the so-called "rich range" starts where the combustion air supplied by the combustion air fan is not sufficient to fully burn the combustion gas. At a higher speed, there is the so-called "lean range" where more combustion air is supplied than required.

This decision criterion cannot be determined by absolute values alone, since it must always take into account the changes related to one another.

Hence, the gradient describes the reaction of the burner (in the form of the ionization voltage) to the change in speed.

Based on the operating state thus found, i.e. the current ionization voltage and the corresponding fan speed, an operating point is determined for the ionization voltage and stored. In addition, the parameters (fan speed or the ionization voltage then changing accordingly) can also be changed in advance, as will be explained later.

This state where the gas burner is to be operated based on the ambient parameters given at that point in time is considered to be optimal.

In the following text, the measurement of the current ionization voltage is carried out continuously or consecutively, i.e. also at certain time intervals, for example. The current ionization voltage measured in each case is compared to the operating point or to the previously stored ionization voltage at the operating point. In this process, a deviation is determined.

In the following text, it is checked whether the deviation thus determined lies within a predefined limit. As long as the deviation lies within the predefined limit, the continuous measurement of the current ionization voltage is continued.

If, however, the deviation does not lie within the predefined limit and thus is too large, the aforedescribed method for determining a new operating point will be repeated. In this case, namely, it is detected that the ambient parameters have changed in such a manner that the burner cannot be operated in the optimal state anymore, which necessitates readjustment by determining a new operating point.

To start the method, it is possible, prior to the measurement of the ionization voltage, to initially operate the fan at a given output speed and subsequently reduce the fan speed. Only then the measurement of the ionization voltage and the subsequent finding of the minimum of the gradient will commence. In this process, the measurement and further processing of the ionization voltage in the aforedescribed manner only makes sense if a flame is generated by the burner, i.e. a flame is ignited.

In one variant, after the step of "finding a minimum of a gradient of the measured ionization voltage with respect to the current fan speed" and prior to the step of "determining an operating point", the additional step is performed that the fan speed is increased by an offset value.

The offset value is dependent on the burner or device specific and thus represents the device specific distance from the minimum speed where the burner operates preferably optimally with regard to exhaust gas values and/or performance.

As set forth above, the method aims at finding a minimum of the gradient of the ionization voltage with respect to the fan speed, so that the burner can be operated in the optimal operating state. However, it is known from practice that in the case of typical burners in this minimum speed, small deviations, for example, with regard to the ambient parameters, may result in the combustion behavior of the burner changing drastically. Therefore, it has turned out to be convenient that the burner is not to be operated in this minimum, but slightly above it. This leads to a "gentler" combustion behavior.

The offset is determined in such a manner that even during operation at extreme values of the operating parameters, the statutory limit values are complied with. For example, in practice, cases occur where the (combustion) gas supplied from, e.g., a gas bottle contains more butane than this is the case for a usual propane/butane mixture. Thus, there is a risk that the CO emission will increase. In this extreme case, the offset is precisely set in such a manner that also during operation with a higher butane percentage in the combustion gas, the statutory maximally reliable limit value will not be exceeded. In other words: The offset is selected in such a manner that one moves away as far as possible from the sensitive minimum value, but not so far that one is outside the statutory standards in the case of special, but real existing and thus known changes in parameters or changes in parameters that can be calculated in advance with regard to their effect.

The determination of the offset value emerges from the operational-test measurement of the type of burner and thus also depends on the extent to which it should be reliable, according to the manufacturer, to move away from the minimum (optimum). Typically, such an offset value can lie in the range from 50 rpm to 1,000 rpm, however, also other values can be reasonable.

For the step of "finding a minimum of a gradient of the measured ionization voltage with respect to the current fan speed", the following steps can be performed:

reducing the fan speed;

measuring the current ionization voltage;

determining the gradient of the measured ionization voltage with respect to the current fan speed;

performing a case discrimination:

If the gradient is less than zero (0), reducing the fan speed and repeating the above steps of measuring the current ionization voltage and finding the gradient. If the gradient is more than zero, increasing the fan speed and repeating the above steps of measuring the current ionization voltage and finding the gradient. If the gradient is equal to zero, determining the gradient as a minimum and continuing the method.

The criterion that the gradient can be "equal to zero" need not mean that it must precisely be equal to "0". Rather, it is sufficient here that the gradient lies below a predefined threshold, i.e. slightly above zero or below zero.

With the aid of the steps described herein, it is possible, by varying the fan speed, to find the minimum of the gradient, so that subsequently this minimum can be determined as the operating point, where required, after adjustment by an offset value, as already explained above.

The output speed of the fan when starting the method should reasonably be set at a high value. For example, the output speed of the fan can be set at a value in the upper third of the speed range of the fan, especially in the upper quarter, in the upper fifth, or in the upper 10% of the speed range. Similarly, it is also possible to select the maximum speed of the fan as the output speed and subsequently reduce the speed to find the minimum of the gradient.

Fan-based gas burners are known where the so-called first ignition point at the start of the burner is automatically determined by a so-called ramp start. In this process, in the case of a defined gas flow rate and a permanently running ignition device, the speed of the combustion air fan is continuously reduced starting from a very high speed until the gas/air mixture has a preferably optimal composition and ignites automatically. The speed measured in this process is then the output speed for any further regulation according to the aforedescribed method.

Alternatively, it is possible to set the output speed of the fan at a previously known firing speed. For example, a known firing speed (dependent on the barometric air pressure, the temperature of the combustion air, and the gas throughput) can be fixed as the starting point.

A common initial speed can, for example, be 4,000 rpm.

The ionization voltage can be determined based on the ionization current in such a manner that the ionization current is determined as the current flow which occurs in the case of a rectification of an alternating voltage caused by the presence of a flame which is applied on an ionization electrode arranged in the flame area, with the ionization current being converted into a corresponding ionization voltage by an evaluation circuit.

A heating device has at least one gas burner, which has a combustion air fan driven by a motor, especially by a speed variable motor, as well as a flame ionization voltage measuring device for detecting an ionization voltage which depends on a flame generated by the gas burner. Furthermore, a processing and control unit is provided, which is coupled to the motor and to the flame ionization voltage measuring device. The processing and control unit can be designed to perform the aforedescribed method and, in this process, regulate the speed of the motor of the combustion air fan especially due to an evaluation of the ionization voltage.

These and additional advantages and features of the invention will be explained in more detail in the following text based on examples with the aid of the accompanying figures, in which:

FIG. 1 shows a very rough representation of the principal structure of a regulation system on which the method according to the invention for regulating a fan-operated gas burner can be performed.

Figure 1:
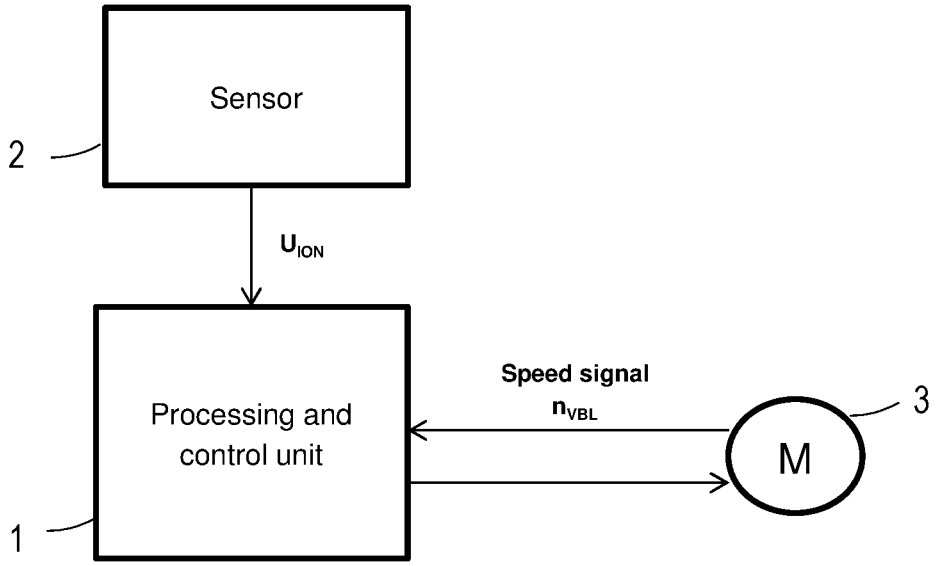
FIG. 1 shows a schematic block diagram of a regulation system for regulating a gas burner.

The regulation system has a processing and control unit 1. In addition, a sensor 2 is provided with which the ionization current in the area of a flame generated by the burner is measured and converted into an ionization voltage $U_{ION}$ with the aid of a suitable evaluation circuit. The ionization voltage $U_{ION}$ is outputted as a measured value and supplied to the processing and control unit 1.

In a practical application, the ionization voltage $U_{ION}$ can, for example, lie in the range between 0.3V to 3.3V depending on the quality of combustion at the output of the measurement circuit when a flame is present. At voltages less than 0.3V, the flame is detected as extinct. To increase the robustness of the detection, a hysteresis window of, for example, 0.3V to 0.7V is provided. This means that in a first-time detection, the flame will only be detected as existing if the ionization voltage reaches at least 0.7V. In contrast, the flame will only be detected as extinct when falling below 0.3V.

The processing and control unit 1 is further connected to a motor 3 of a combustion air fan not shown. In particular, the processing and control unit 1 can control the speed of the motor 3 and thus of the combustion air fan. Conversely, it is required that the processing and control unit 1 receives information about the speed $n_{VBL}$ of the motor 3 and thus of the combustion air fan. The speed information can be determined in a suitable manner. Thus, it is possible that the processing and control unit 1 already itself specifies the speed through a corresponding control of the motor 3. Similarly, sensors (e.g. one or more Hall sensors) can be provided on the motor 3 to determine the speed of the motor 3. For this purpose, different possibilities are known which need not be explored at this point.

The control of the rotation speed of the motor 3 and thus of the speed of the combustion air fan can, for example, be specified by a pulse width modulation in a range from 0% to 100% of the rotation speed. Alternatively, the drive voltage of the motor 3 or the drive current of the motor for speed regulation can also be set directly.

Figure 2:
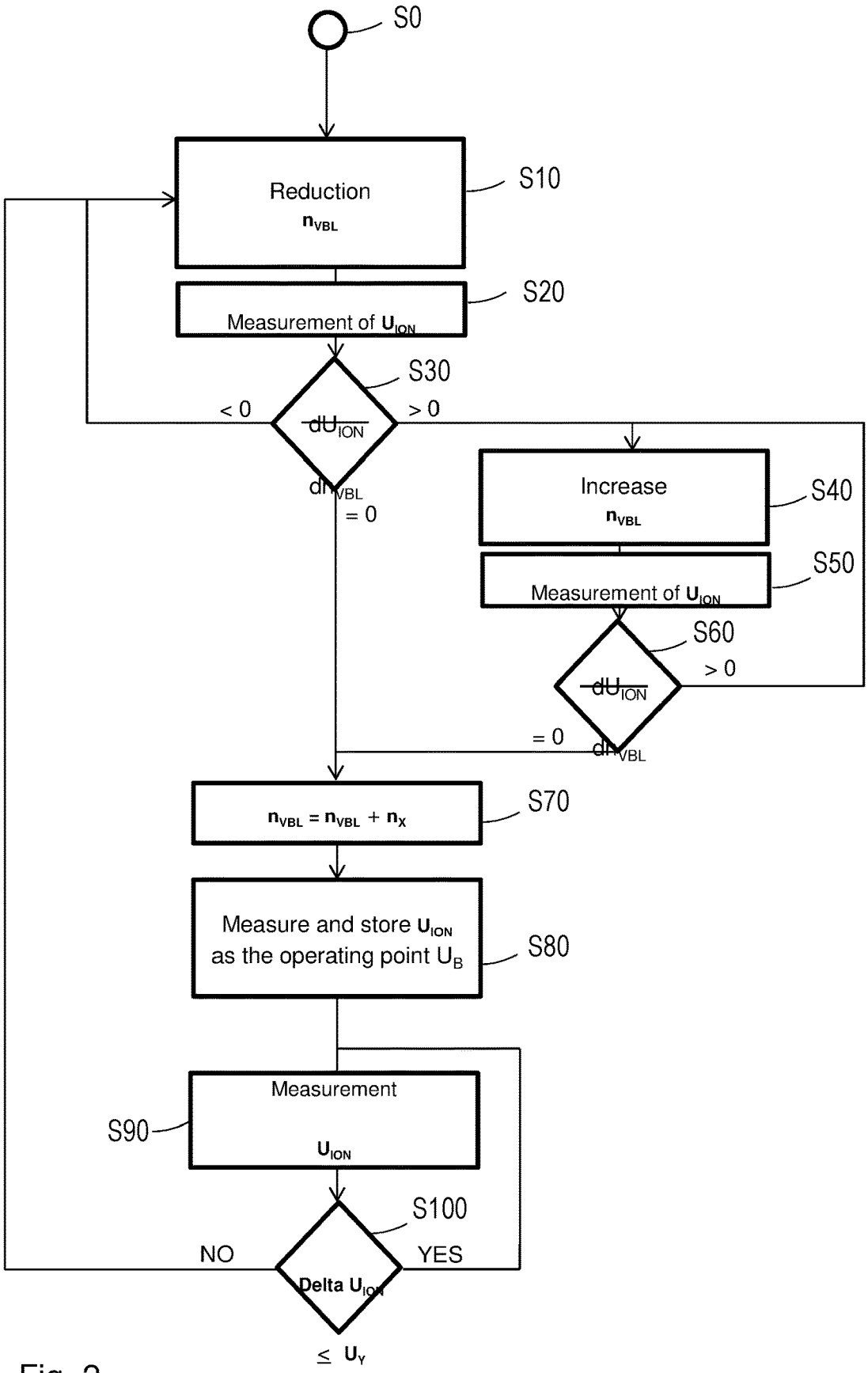
FIG. 2 shows a flow diagram with a regulation method for a fan-operated gas burner.

FIG. 2 shows a flow diagram with a method for regulating a fan-operated gas burner.

At the start of the method, the combustion air fan is, at a starting point SO, operated at an output speed which should correspond to a relatively high speed.

Based on this speed, the speed $n_{VBL}$ is reduced in step S10. In step S20, the ionization voltage $U_{ION}$ is measured in the aforedescribed manner.

In the following text, a gradient of the ionization voltage $U_{ION}$ is determined with respect to the speed $n_{VBL}$ in step S30. If the gradient is less than 0, the method proceeds to step S10, so that the speed $n_{VBL}$ is further reduced.

If, however, the gradient in step S30 is more than 0, the speed is increased in step S40. In the following text, the ionization voltage $U_{ION}$ is measured in step S50 again, and the gradient is determined in step S60.

If the gradient is then still more than 0, the speed is further increased in step S40, and a gradient is determined in step S60 again.

If it has been detected in step S30 or S60 that the gradient is 0 or very close to 0, this is detected as the minimum of the gradient (related to the amount value) and thus as the optimum. At the same time, this point also corresponds to a minimum speed for the fan speed.

In this process, the "minimum of the gradient" is to be understood as the absolute value. Thus, the minimum of the gradient is found at the value 0, while values more or less than 0 lie above the minimum.

This operating point thus detected means that the ratio between air supply (specified by the combustion air fan) and combustion gas supply for the burner is optimal, so that the energy content of the combustion gas can be optimally exploited with minimal exhaust emission at the same time. Thus, the burner is operated in an optimal operation state.

A further reduction of the fan speed would result in too little combustion air being supplied, so that the mixture to be burnt would be set too rich. An unnecessarily high consumption of combustion gas would be the consequence.

In step S70, the speed is changed with the aid of an offset speed $n_X$. This change in step S70 is optional and need not necessarily be performed. However, it has transpired that in the case of common burners during operation in the aforedescribed minimum speed, small deviations, for example, with regard to the ambient parameters, may result in the combustion behavior of the burner changing drastically. To allow greater tolerance and thus a gentler behavior, the minimum value for the speed just found within the scope of step S30 or S60 is increased by the offset value $n_X$. The $n_X$ value emerges from operational-test measurements of the type of burner used and can be determined by the manufacturer depending on the design target.

In the following text, the ionization voltage for the "optimal" speed thus newly determined is measured and stored as the operating point $U_B$ in step S80.

At this operating point, the burner can be optimally operated, on the condition that the ambient parameters do not change or only change slightly.

During the subsequent operation, the ionization voltage is continuously measured in step S90 and thus the quality of the flame detected. In this process, the ionization voltage can be measured continuously or at regular or otherwise specified time intervals.

A difference between the ionization voltage $U_{ION}$ measured in step S90 and the ionization voltage determined as the operating point $U_B$ in step S80 is determined in the form of the value of delta $U_{ION}$ in step S100. This deviation of the ionization voltage values is then compared to a value $U_Y$ which is a decision criterion for the admissible change in the ionization voltage.

If it is determined in step S100 that the deviation of the current ionization voltage $U_{ION}$ from the ionization voltage specified for the operating point is less than or equal to the value $U_Y$, the measurement in step S90 is further continued and the operation of the burner maintained unchanged.

If, however, it is determined in step S100 that the deviation is too large, the method determines that readjustment of the operating point is required. A reason for this can, for example, be a change of one or more ambient parameters which results in the burner not being able to be operated anymore at the optimal operating point at this point in time.

Thereupon, the method is performed again by reducing the speed in step S10. Prior to that, the speed can reasonably be increased to a higher value (output speed) again in order to be able to conduct a change in speed over a larger range.

The invention claimed is:

1. A method for regulating a gas burner, wherein the gas burner has a combustion air supply fan, the speed of which can be variably set, the method comprising:

(a) operating the combustion air supply fan and detecting a fan speed;

(b) changing the fan speed;

(c) measuring an ionization voltage which correlates to an ionization current in a flame area of the gas burner;

(d) finding a minimum of a gradient of the measured ionization voltage with respect to the current change in fan speed;

(e) determining an operating point by measuring the current ionization voltage and storing the measured current ionization voltage as an operating point;

(f) during operation of the burner, continuously measuring the current ionization voltage;

(g) determining a deviation between the currently measured ionization voltage and the operating point;

(h) checking whether the deviation lies within a predefined limit and performing a case discrimination, including:

if the deviation lies within the predefined limit, continuing the continuous measurement of the current ionization voltage;

if the deviation does not lie within the predefined limit, repeating (b) through (h).

2. The method of claim 1, wherein to start the method, the following steps are performed prior to the measurement of the ionization voltage:

operating the combustion air supply fan at an output speed; and reducing the fan speed.

3. The method of claim 1, further comprising:

after finding the minimum of the gradient of the measured ionization voltage with respect to the current change in fan speed and prior to determining the operating point, increasing the fan speed by an offset value.

4. The method of claim 1, wherein finding the minimum of the gradient of the measured ionization voltage with respect to the current change in fan speed comprises:

reducing the fan speed;

measuring the current ionization voltage;

determining the gradient of the measured ionization voltage with respect to the current change in fan speed; and performing a case discrimination, including:

if the gradient is less than zero, reducing the fan speed and repeating the steps of measuring the current ionization voltage and finding the gradient;

if the gradient is more than zero, increasing the fan speed and repeating the steps of measuring the current ionization voltage and finding the gradient;

if the gradient is equal to zero, determining the gradient as a minimum and continuing the method.

5. The method of claim 1, wherein an output speed of the combustion air supply fan is set to a value in an upper third of a speed range of the combustion air supply fan.

6. The method of claim 1, wherein an output speed of the combustion air supply fan is set to a previously known firing speed.

7. The method of claim 1, wherein the ionization voltage is determined, based on the ionization current, such that:

the ionization current is determined as a current flow, which occurs in case of a rectification of an alternating voltage effected by the presence of a flame, which is applied to an ionization electrode arranged in the flame area; and the ionization current is converted into a corresponding ionization voltage by an evaluation circuit.

8. A heating device, comprising:

at least one gas burner which has a combustion air supply fan driven by a motor;

a flame ionization voltage measuring device configured to detect an ionization voltage which is dependent on a flame generated by the gas burner; and a processing and control unit coupled to the motor and to the flame ionization voltage measuring device, wherein the processing and control unit is configured to:

(a) operate the combustion air supply fan and detect a fan speed;

(b) change the fan speed;

(c) measure an ionization voltage which correlates to an ionization current in a flame area of the gas burner;

(d) find a minimum of a gradient of the measured ionization voltage with respect to the current change in fan speed;

(e) determine an operating point by measuring the current ionization voltage and storing the measured current ionization voltage as an operating point;

(f) during operation of the burner, continuously measure the current ionization voltage;

(g) determine a deviation between the currently measured ionization voltage and the operating point;

(h) check whether the deviation lies within a predefined limit and performing a case discrimination, including:

if the deviation lies within the predefined limit, continue the continuous measurement of the current ionization voltage;

if the deviation does not lie within the predefined limit, repeat (b) through (h).

9. The heating device of claim 8, wherein to start the heating device, the processing and control unit is configured to operate the combustion air supply fan at an output speed and reduce the fan speed, bot prior to the measurement of the ionization voltage.

10. The heating device of claim 8, the processing and control unit is further configured to:

after finding the minimum of the gradient of the measured ionization voltage with respect to the current change in fan speed and prior to determining the operating point, increase the fan speed by an offset value.

11. The heating device of claim 8, wherein the processing and control unit is configured to:

reduce the fan speed;

measure the current ionization voltage;

determine the gradient of the measured ionization voltage with respect to the current change in fan speed; and perform a case discrimination, including:

if the gradient is less than zero, reduce the fan speed and repeating the steps of measuring the current ionization voltage and finding the gradient;

if the gradient is more than zero, increase the fan speed and repeating the steps of measuring the current ionization voltage and finding the gradient;

if the gradient is equal to zero, determine the gradient as a minimum and continuing the heating device.

12. The heating device of claim 8, wherein the processing and control unit is configured to set an output speed of the combustion air supply fan to a value in an upper third of a speed range of the combustion air supply fan.

13. The heating device of claim 8, wherein the processing and control unit is configured to set an output speed of the combustion air supply fan to a previously known firing speed.

14. The heating device of claim 8, wherein the processing and control unit is configured to determine the ionization voltage, based on the ionization current, such that:

the ionization current is determined as a current flow, which occurs in case of a rectification of an alternating voltage effected by the presence of a flame, which is applied to an ionization electrode arranged in the flame area; and the ionization current is converted into a corresponding ionization voltage by an evaluation circuit.

* * * * *